US007341226B2

(12) United States Patent
Biagiotti et al.

(10) Patent No.: US 7,341,226 B2
(45) Date of Patent: Mar. 11, 2008

(54) MOVABLE POINT FROG SWITCHING ASSEMBLY

(75) Inventors: Maurizio Biagiotti, Pisa (IT); Wallace M. Catanach, III, Grain Valley, MO (US); Charles D. Crawford, Blue Springs, MO (US); Miles Metschke, Kansas City, MO (US)

(73) Assignee: General Electric Company, Schenectady, NY (US)

( * ) Notice: Subject to any disclaimer, the term of this patent is extended or adjusted under 35 U.S.C. 154(b) by 296 days.

(21) Appl. No.: 11/248,725

(22) Filed: Oct. 11, 2005

(65) Prior Publication Data

US 2006/0102804 A1 May 18, 2006

Related U.S. Application Data

(60) Provisional application No. 60/629,178, filed on Nov. 17, 2004.

(51) Int. Cl.
*E01B 7/00* (2006.01)

(52) U.S. Cl. ..... 246/449; 246/450; 246/435 R

(58) Field of Classification Search ..... 246/321, 246/382, 385, 386, 387, 388, 389, 390, 391, 246/392, 415 R, 430, 435 R, 442, 445, 449, 246/450, 451, 452, 453
See application file for complete search history.

(56) References Cited

U.S. PATENT DOCUMENTS 4,093,163 A * 6/1978 Larsson ..... 246/476
5,527,005 A * 6/1996 Wydotis ..... 246/452
2004/0069911 A1 4/2004 Schnedl

FOREIGN PATENT DOCUMENTS

WO WO 2004/014709 A1 2/2004

* cited by examiner

*Primary Examiner*—Mark T. Le
(74) *Attorney, Agent, or Firm*—Gerald W. Spinks

(57) ABSTRACT

A lost motion apparatus for adapting a typical in-tie switch machine, designed for use with interconnected switch points, to be used as an in-tie machine for moving the movable V-point of a movable point frog assembly.

6 Claims, 6 Drawing Sheets

MOVABLE POINT FROG SWITCHING ASSEMBLY

CROSS REFERENCE TO RELATED APPLICATIONS

This application relies upon U.S. Provisional Patent Application No. 60/629,178, filed on Nov. 17, 2004, and entitled "Movable Point Frog Switching Assembly."

STATEMENT REGARDING FEDERALLY SPONSORED RESEARCH OR DEVELOPMENT

Not Applicable

BACKGROUND OF THE INVENTION

1. Field of the Invention

This invention refers to railway switching machines, and, in particular, to those devices which are used to move the rail end points of switch point assemblies or the movable V-points of movable point frog assemblies.

2. Background Art

As shown in FIG. 1, railway switch point assemblies include two rail end points which are tapered rail profiles capable of deflecting to move between two different positions, in order to facilitate the correct alignment of the track components for the desired path of rolling stock transiting through the switch point assembly. The switch point assembly has two deflectable or movable rail end points A which move in concert with one another between first and second alternative positions. The rail end points A are often interconnected, such as by means of an interconnecting link IL. In a first alternative position, a first one of these movable rail end points A can be aligned with a first fixed stock rail C to facilitate passage of the rolling stock straight through the switch point onto a first set of fixed rails. In a second alternative position, the second movable rail end point A can be aligned with a second fixed stock rail C to facilitate passage of the rolling stock onto a second set of fixed rails, such as to divert the rolling stock onto a siding. In FIG. 1, for example, the right end point A is in contact with the right stock rail C. The remote ends of the two deflectable rails almost intersect, near the location where the second set of fixed rails diverges from the first set of fixed rails. Typically, a motor unit MU drives a switch machine SM, which shifts two connecting rods CR to the right or left, in unison, to move the rail end points A. The motor unit and the switch machine may be installed in a housing H which is adapted to replace a railroad tie, referred to as an "in-tie" installation.

At the ends of the deflectable rails where they almost intersect, it is necessary to provide a means for the rims of the wheels of the rolling stock to cross the fixed rail C which is not being followed, and to pass from one of the deflectable rails onto the desired set of fixed rails. Frog assemblies are used for this purpose, wherein the left rail of one set of rails beyond the frog assembly, and the right rail of the other set of rails beyond the frog assembly form a "V-point" adjacent to the point where the deflectable rails cross. At this point, the remote ends of the deflectable switch point rails can form "wing rails" on either side of the V-point.

Some of these frog assemblies can have a fixed V-point, a fixed wing rail, and a deflectable wing rail which can deflect as the wheel rims pass through, allowing the rolling stock to follow the desired set of fixed rails. These are "fixed point" frog assemblies. Still other frog assemblies can have fixed wing rails and a moving or deflectable V-point which can be aligned with either of the wing rails, according to the desired path of the rolling stock. These are commonly called "movable point" frog assemblies.

The state of the art includes numerous switch point machines for railway split point movements. For example, EP 1,245,469 to Biagiotti describes such a switch point machine. Such mechanisms are normally installed at the switch point, and they are typically applied only to move the split rail end points of the switch point assembly. For operational reliability and safety, it is common to sense the positions of the rail end points, typically with proximity sensors.

Known in-tie switch machines cannot be installed under a movable point frog assembly and used to move the movable V-point. Rather, switch machines for the movable point frog application are installed to the side of the track, some distance from the V-point. As a result, proximity sensors must be placed near linkage elements which are far removed from the V-point itself, resulting in less accuracy and less reliability. One difficulty in adapting any known in-tie switch machines for use in moving the V-point of a movable point frog assembly is that the switch points and the movable V-points are designed for different stroke lengths. That is, switch points are designed for a stroke length of 4.75 inches, while the V-point of a movable point frog assembly is designed for a stroke length of only 3.0 inches.

Therefore, it is desirable to provide a simple type of in-tie mechanism which can be used to adapt a typical switch machine to move the deflectable V-point of a movable point frog assembly. Use of the same type of switch machine in an in-tie installation, to shift either the switch points or the V-point, will simplify the maintenance and operation of the apparatus at a given turnout. Further, provision of an in-tie switch machine for movable point frog applications will enable the placement of proximity sensors near the V-point, but still within the in-tie housing of the apparatus.

BRIEF SUMMARY OF THE INVENTION

The present invention is an in-tie apparatus which can be attached to a typical switch machine designed for interconnected switch points, to adapt the switch machine to be used in moving the V-point of a movable point frog assembly. A sliding yoke is mounted to the ends of the two connecting rods protruding from the switch machine, to move in concert with the connecting rods. The sliding yoke is connected to one end of a connecting bar which moves longitudinally, in concert with the sliding yoke. The movable V-point of the frog assembly is mounted to a shifting plate which is mounted so that it can slide transversely relative to the track rails. Proximity sensors can be mounted within the housing and positioned either near the two alternative positions of the V-point or near the two end positions of the shifting plate, to sense the actual position of the V-point. The shifting plate is pivotably mounted to the end of a shifting fork. The shaft of the shifting fork is slidingly mounted in a bore through a fork support block. The fork support block is rigidly mounted to the connecting bar. The shifting fork and the fork support block are adapted to shorten the stroke of the switch machine to make it suitable for shifting the V-point of the frog assembly. This is accomplished by having the shaft of the fork slide within the bore of the fork support block. Two fork stops are fixedly mounted on the fork shaft, with the fork stops being positioned apart, at the required distance so that the fork support block travels 1.75 inches from one fork stop to the other fork stop, without moving the shifting fork. This spacing between the fork stops provides 1.75 inches of "slack" or "lost motion", in the attachment of the connecting bar to the shifting fork.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
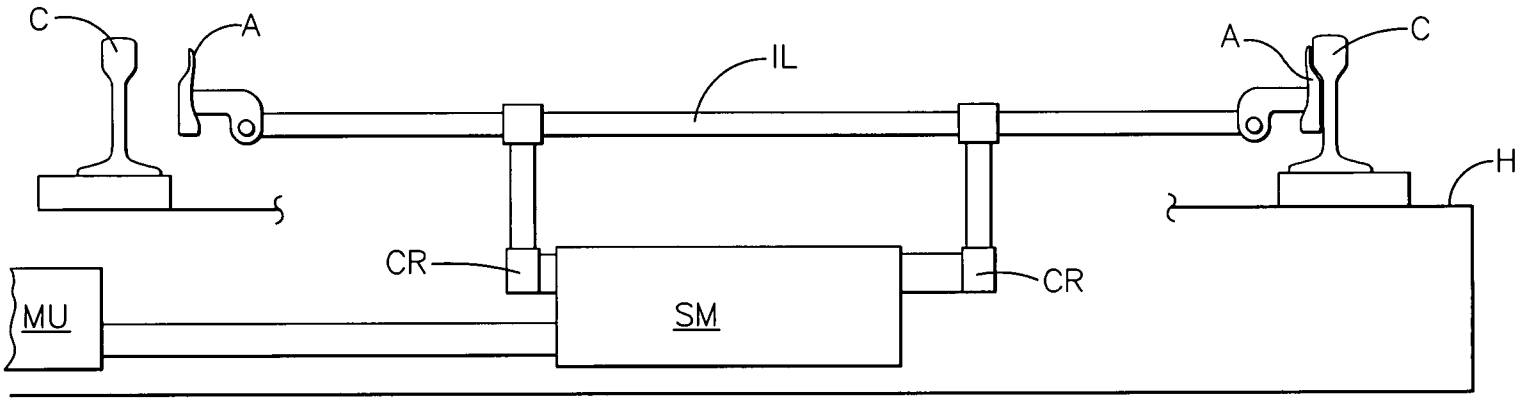
FIG. 1 (PRIOR ART)
FIG. 1 is a typical prior art switch machine installation for interconnected switch points.
Figure 2:
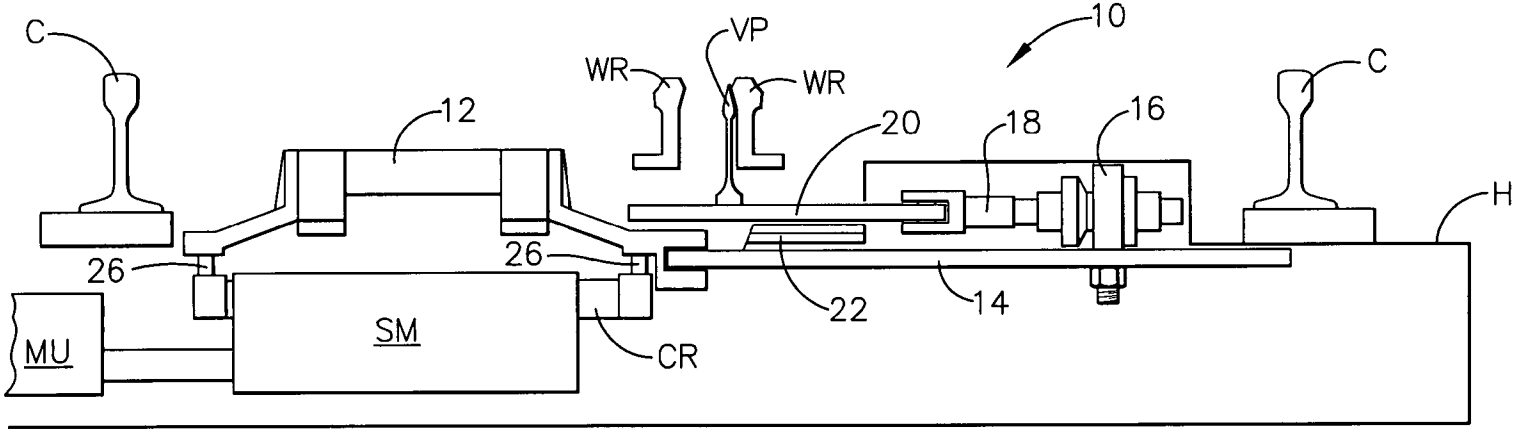
FIG. 2 is a schematic view of the apparatus of the present invention.
Figure 4:
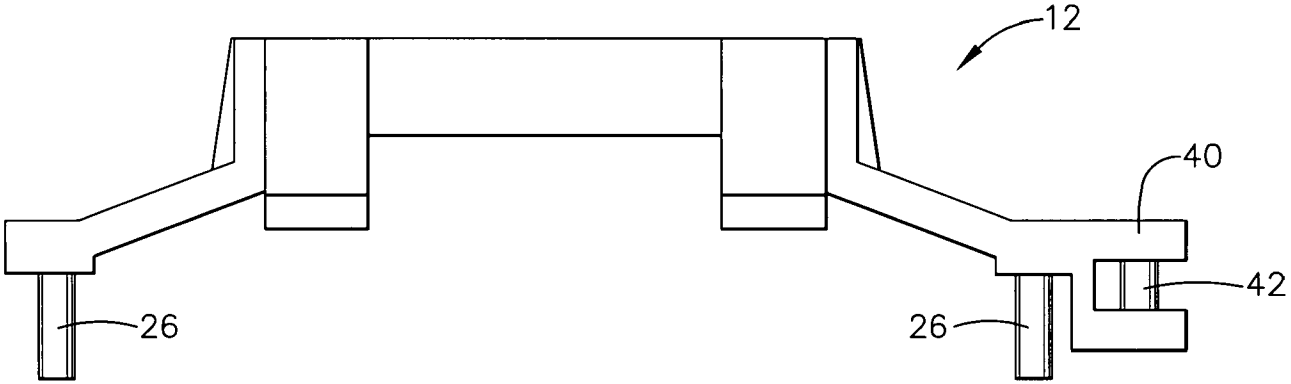
FIG. 4 is an elevation view of a sliding yoke for use in the apparatus of FIG. 2.

As shown in FIG. 2, the apparatus 10 of the present invention includes an in-tie housing H adapted for replacement of a railroad tie, to position and support the stock rails C and the V-point VP and wing rails WR of the movable point frog assembly. A motor unit MU is adapted to drive a typical switch machine SM designed for operating interconnected switch points. Both the motor unit MU and the switch machine SM can be contained within the housing H. A pair of connecting rods CR protrude from the switch machine SM, one from either end. A sliding yoke 12, seen in more detail in FIG. 4, is pinned to the ends of the connecting rods CR by the yoke pins 26, so that the sliding yoke 12 moves to the left or right as the connecting rods CR move.

Figure 5:
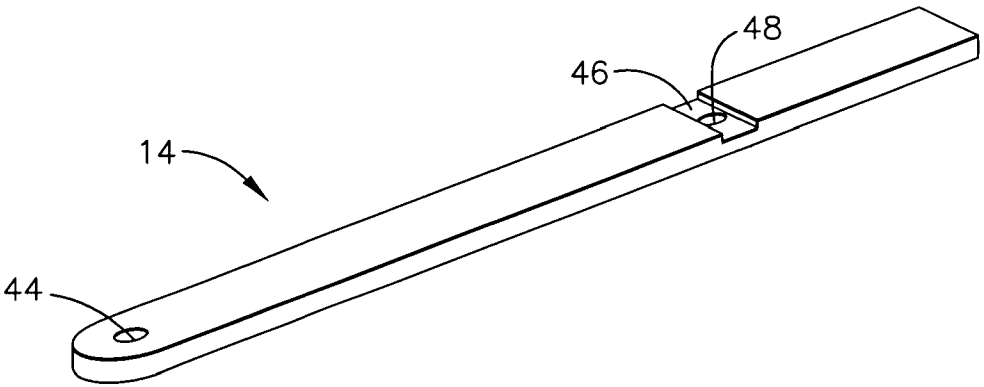
FIG. 5 is a perspective view of a connecting bar for use in the apparatus of FIG. 2.

A connecting bar 14, seen in more detail in FIG. 5, is positioned horizontally within the housing H, in substantial alignment the connecting rods CR. One end of the connecting bar 14 is pivotably pinned to one end of the sliding yoke 12 by the connecting pin 42. The connecting pin 42 passes through a bore 44 in the end of the connecting bar 14.

Figure 10:
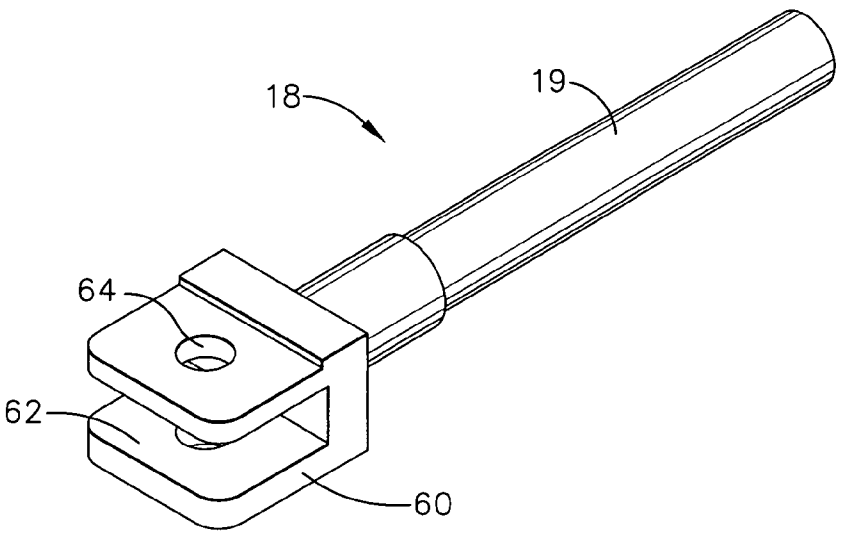
FIG. 10 is a perspective view of a shifting fork for use in the apparatus of FIG. 2.
Figure 11:
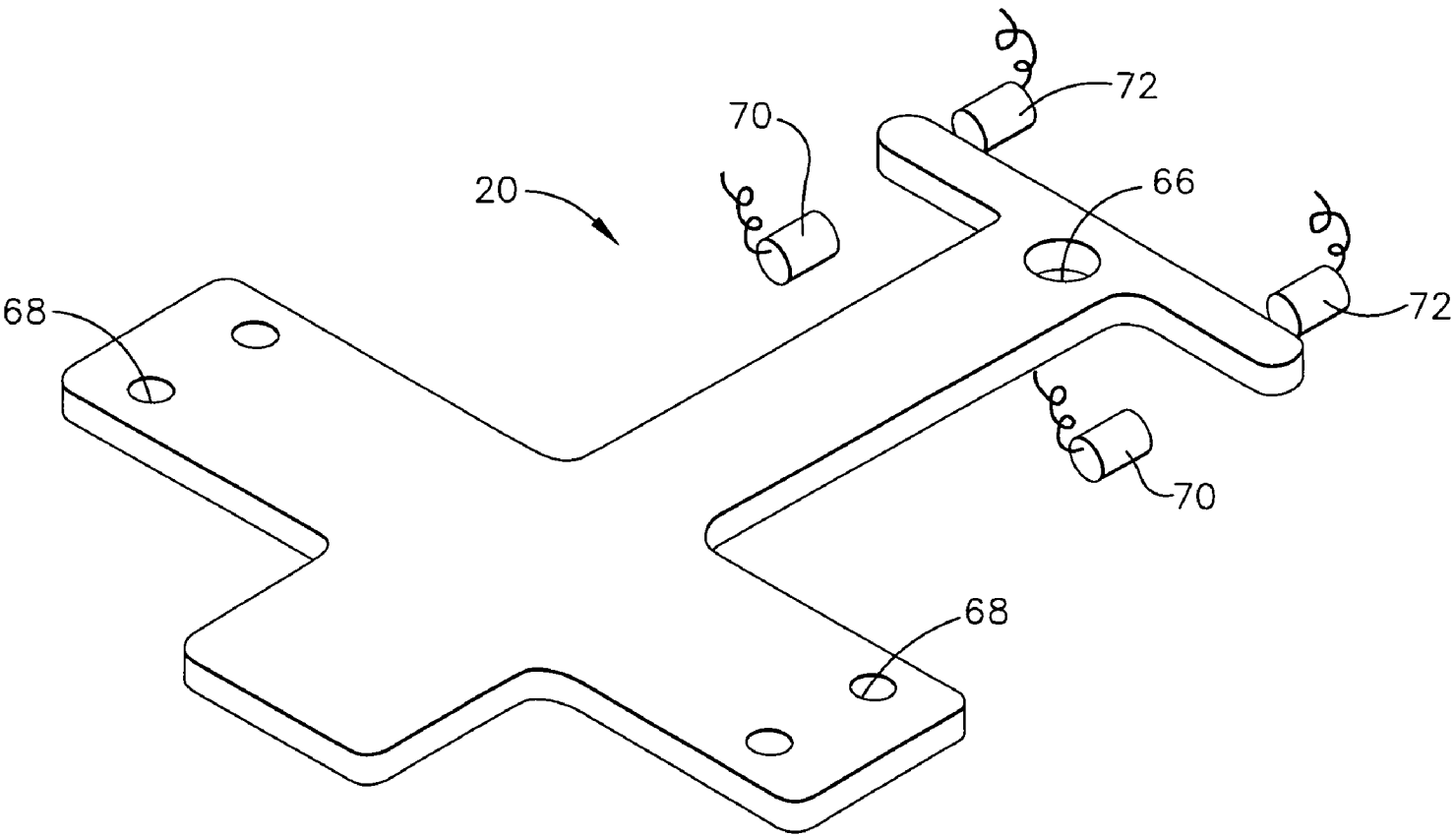
FIG. 11 is a perspective view of a shifting plate for mounting of the V-point.

The movable V-point VP is mounted to a shifting plate 20, seen in more detail in FIG. 11. The V-point VP can be mounted to the bolt holes 68 in the shifting plate 20. Two left proximity sensors 70 and two right proximity sensors 72 can be mounted within the housing H and positioned as shown to sense when the shifting plate 20 is in either its leftmost or its rightmost position. This gives an independent indication of the actual position of the V-point. Alternatively, the proximity sensors could be mounted near the actual end positions of the V-point itself, or near the end positions of any other structure which may be fixedly mounted to the V-point. The shifting plate 20 can be supported by one or more support plates 22, as required to allow the shifting plate and the V-point VP to move to the left and right. A bore 66 in the other end of the shifting plate 20 is pivotably pinned to a shifting fork 18, seen in more detail in FIG. 10. That is, the shifting plate 20 fits into the slot 62 of the forked head 60 of the shifting fork 18. A bore 64 is provided through the head 60, to receive a fork pin 38, shown better in FIG. 3, to pin the shifting plate 20 to the shifting fork 18.

Figure 3:
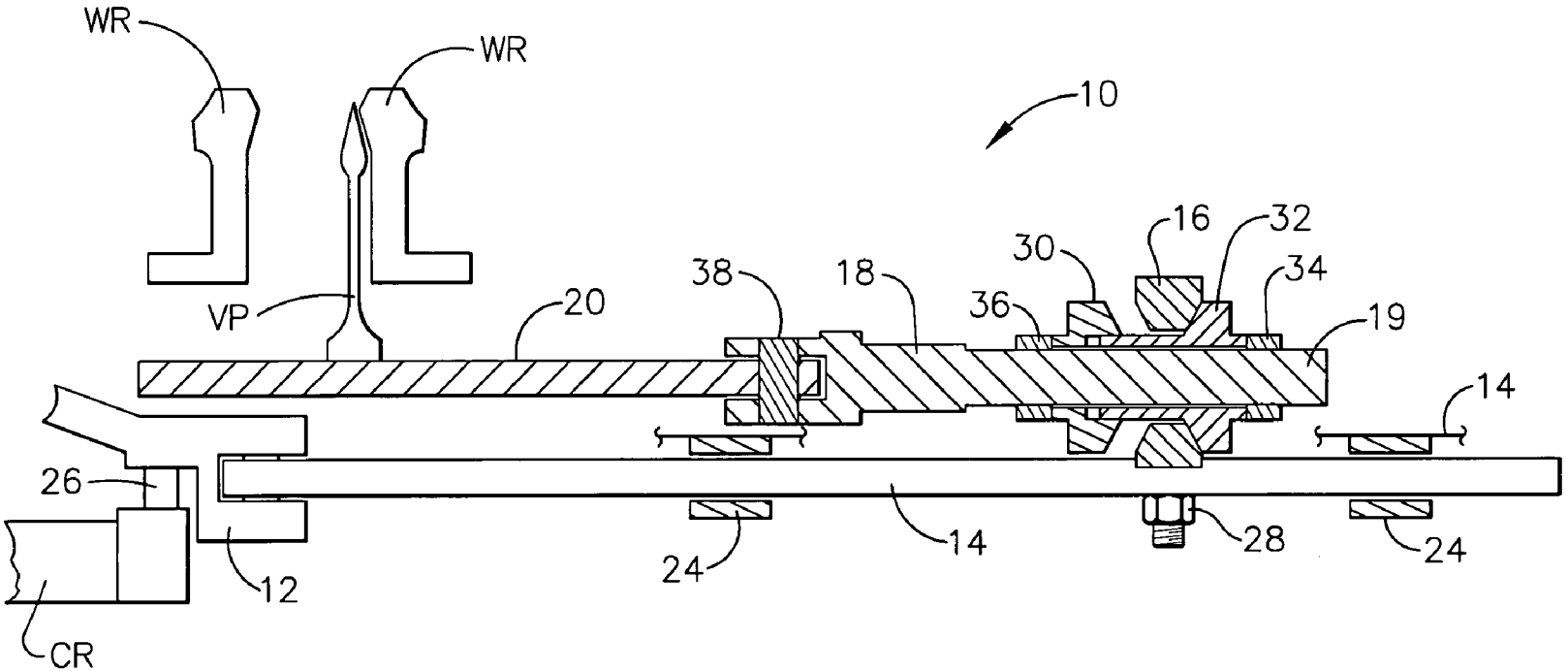
FIG. 3 is a partial section view of the apparatus of FIG. 2, showing the attachment of the connecting bar to the shifting fork.
Figure 7:
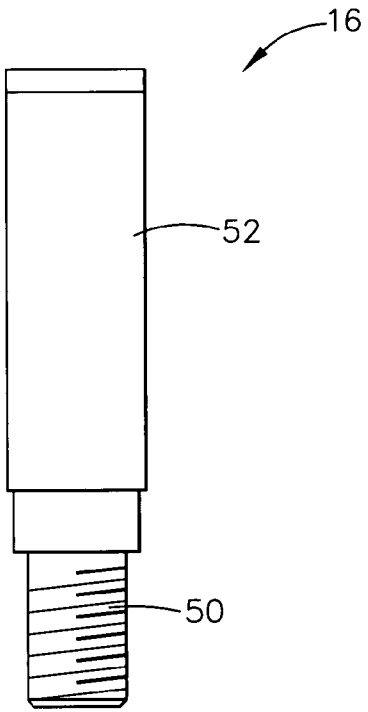
FIGS. 6, 7, and 8, show the details of the fork support block for use in the apparatus of FIG. 2.
Figure 6:
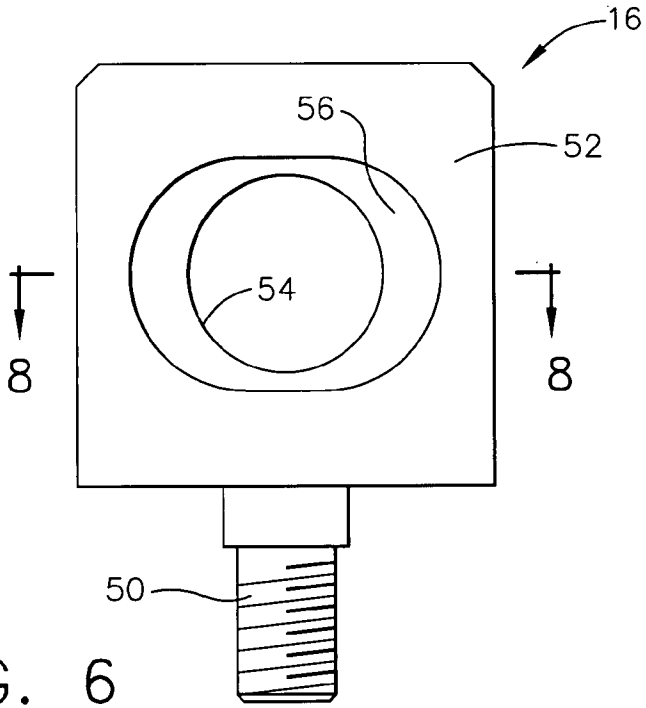

A fork support block 16, seen in more detail in FIGS. 6 and 7, is mounted to the connecting bar 14. The fork support block 16 slidingly connects the threaded shaft 19 of the shifting fork 18 to the connecting bar 14. As shown in FIGS. 3 and 5, the fork support block 16 is mounted in a notch 46 in the connecting bar 14. A mounting stud 50 on the fork support block 16 is retained in a bolt hole 48 through the connecting bar 14, in the notch 46, by a block retaining nut 28. The connecting bar 14 can be slidingly supported within the housing H by two or more brackets 24.

Figure 8:
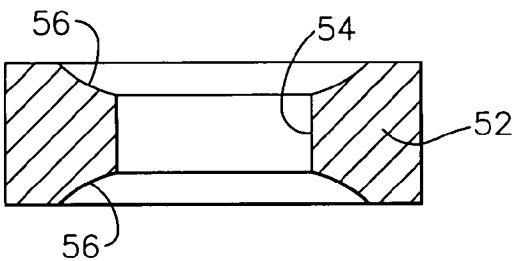
Figure 9:
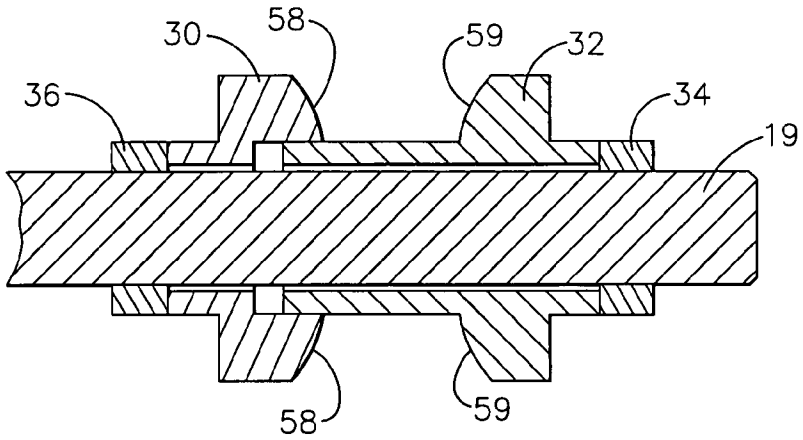
FIG. 9 is a section view showing the mounting of the fork stops on the shifting fork shaft.

As shown in FIG. 3, left and right fork stops 30, 32 are fixedly mounted to the threaded shaft 19 of the shifting fork 18 by being threaded thereto, and held in place longitudinally by left and right lock nuts 36, 34, which are threaded to the shaft 19. As an alternative to threading the shaft 19 of the shifting fork 18, other means such as pins could be provided for fixedly attaching the fork stops 30, 32 to the shaft 19. As shown in FIG. 8, the body 52 of the fork support block 16 has a through bore 54 for passage of the shaft 19 of the shifting fork 18. FIG. 8 also shows that the bore 54 has substantially spherical concave edges 56. These concave surfaces receive substantially spherical convex surfaces 58, 59 on the fork stops 30, 32. The distance between the spherical surfaces 58, 59 is set by moving the fork stops 30, 32 toward or away from each other, and fixing them in place with the lock nuts 36, 34. This distance is selected so that the fork support block 16 moves a distance of 1.75 inches from one fork stop to the other. Both fork stops 30, 32 can be moved either to the left or to the right, to correctly align the V-point VP with the wing rails WR at the ends of the stroke.

The switch machine SM is shown at the right hand end of its stroke, and the V-point VP is in contact with the right wing rail WR. It can be seen that, when the motor unit MU drives the switch machine SM through its full 4.75 inch stroke to the left, the first 1.75 inches of the motion of the connecting bar will be "lost", in that the fork support block 16 will move 1.75 inches from the right fork stop 32 to the left fork stop 30 before the shifting fork 18 will begin to move. Thereafter, the final 3.0 inches of the movement of the connecting bar 14 will move the V-point VP by 3.0 inches, from contact with the right wing rail WR to contact with the left wing rail WR.

As the V-point VP moves to the left or right, it will actually follow a large diameter arc, since the far end of the V-point is basically fixed. This causes the shifting plate 20 to rotate slightly in a horizontal plane, as it moves longitudinally. This will cause the pin bore 66 in the shifting plate 20 to follow an arc, causing the head 60 of the shifting fork 18 to also move slightly transversely to the axis of the shifting fork, as it moves longitudinally. To prevent this from causing any binding of the mechanism, the shaft bore 54 of the fork support block 16 is formed sufficiently large, elliptical, and with spherical concave edges 56, to allow the shaft 19 of the shifting fork 18 to pivot within the shaft bore 54 without binding.

We claim:

1. An in-tie apparatus for shifting a movable V-point of a railroad switch point apparatus, said in-tie apparatus comprising:

a housing shaped and sized to replace a railroad tie;

a switch machine within said housing;

at least one connecting rod slidably protruding from said switch machine;

a motor unit within said housing, said motor unit being adapted to drive said switch machine to move said at least one connecting rod longitudinally through a first range of motion having a first length; and a lost motion mechanism connected between said at least one connecting rod and said movable V-point, said lost motion mechanism being adapted to move said movable V-point through a second range of motion in response to said movement of said connecting rod through said first range of motion, said second range of motion of said movable V-point having a second length which is less than said first length of said first range of motion of said connecting rod;

wherein said lost motion mechanism comprises:

a sliding connector adapted to allow relative sliding movement between said at least one connecting rod and said movable V-point;

two motion stops adapted to limit said relative sliding movement between said connecting rod and said movable V-point to a lost motion distance equal to the difference between said first length and said second length;

a shaft connected to move substantially longitudinally with a selected one of said connecting rod or said movable V-point;

a connecting bar connected to said at least one connecting rod for longitudinal movement with said at least one connecting rod; and a shifting plate connected to said movable V-point for translational movement with said movable V-point;

wherein:

said sliding connector comprises a shaft support block mounted to the other of said connecting rod or said movable V-point, said support block being adapted to slidably receive said shaft;

said motion stops comprise two shaft stops mounted to said shaft, said shaft stops being adapted to limit relative sliding movement between said support block and said shaft to said lost motion distance;

said support block is adapted to allow pivotal movement of said shaft relative to said support block as said shaft slides relative to said support block;

said shaft is adapted to pivot relative to said selected one of said connecting rod or said movable V-point;

said shaft is pivotably connected to a selected one of said connecting bar or said shifting plate; and said support block is mounted to the other of said connecting bar or said shifting plate.

2. The in-tie apparatus recited in claim 1, wherein said motion stops are selectively positionable along said shaft to locate said range of motion of said movable V-point to cause said movable V-point to contact fixed wing rails at each end of said range of motion of said movable V-point.

3. The in-tie apparatus recited in claim 1, wherein:

said shaft is pivotably connected to said shifting plate; and said support block is mounted to said connecting bar.

4. A lost motion mechanism for use in adapting an in-tie switch point shifting apparatus for shifting a movable V-point of a railroad movable point frog apparatus, said lost motion apparatus comprising:

a connecting bar connected to at least one connecting rod of a switch machine for longitudinal movement with said at least one connecting rod through a first range of motion having a first length; and a shifting plate connected to said movable V-point for translational movement with said movable V-point through a second range of motion having a second length less than said first length;

a shifting fork connected to said shifting plate;

a shifting fork support block mounted to said connecting bar, said support block being adapted to slidably receive said shifting fork;

two shifting fork stops mounted to said shifting fork, said shifting fork stops being adapted to limit relative sliding movement between said support block and said shifting fork to a lost motion distance equal to the difference between said first length and said second length.

5. The lost motion mechanism recited in claim 4, wherein said shifting fork stops are selectively positionable along said shifting fork to locate said range of motion of said movable V-point to cause said movable V-point to contact fixed wing rails at each end of said range of motion of said movable V-point.

6. The lost motion mechanism recited in claim 4, wherein:

said support block is adapted to allow pivotal movement of said shifting fork relative to said support block as said shifting fork slides relative to said support block; and said shifting fork is adapted to pivot relative to said shifting plate.

* * * * *